United States Patent [19]

Mockovak

[11] Patent Number: 4,746,120

[45] Date of Patent: May 24, 1988

[54] GOLF CLUB PUTTER AND HANDGRIP THEREFOR

[76] Inventor: Richard M. Mockovak, 1995 W. 116th St., Carmel, Ind. 46032

[21] Appl. No.: 935,957

[22] Filed: Nov. 28, 1986

[51] Int. Cl.[4] ..... A63B 53/14

[52] U.S. Cl. ..... 273/81.5; 273/81.3; 273/81 A

[58] Field of Search ..... 273/81 R, 81.4, 81.5, 273/81 B, 81 A, 81 C, 81 D, 165, 81.2, 81.3, 81.6

[56] References Cited

U.S. PATENT DOCUMENTS

| | | | |
|---|---|---|---|
| 3,606,326 | 9/1971 | Sparks | 273/81 R |
| 4,067,573 | 1/1978 | Key, Jr. | 273/81.4 |
| 4,215,860 | 8/1980 | Nakamatsu | 273/81 R |
| 4,272,077 | 6/1981 | Spivey | 273/81 R |
| 4,338,270 | 7/1982 | Uffindell | 264/46.4 |

*Primary Examiner*—George J. Marlo
*Attorney, Agent, or Firm*—Woodard, Emhardt, Naughton, Moriarty & McNett

[57] ABSTRACT

An improved grip for a golf putter includes a cylindrically shaped body made of balsa wood. The body has an axial bore for receipt of the shaft of the putter. The diameter of the body is at least two and one half inches with a length of at least eight inches. The exterior of the body is covered with a grip coating consisting of diagonally wrapped strips of rubber or leather. An alternative embodiment consists of the same cylindrically shaped body with the axial bore being offset from the central axis of the body by approximately one half inch in the direction of the normal to the face of the putter head.

16 Claims, 3 Drawing Sheets

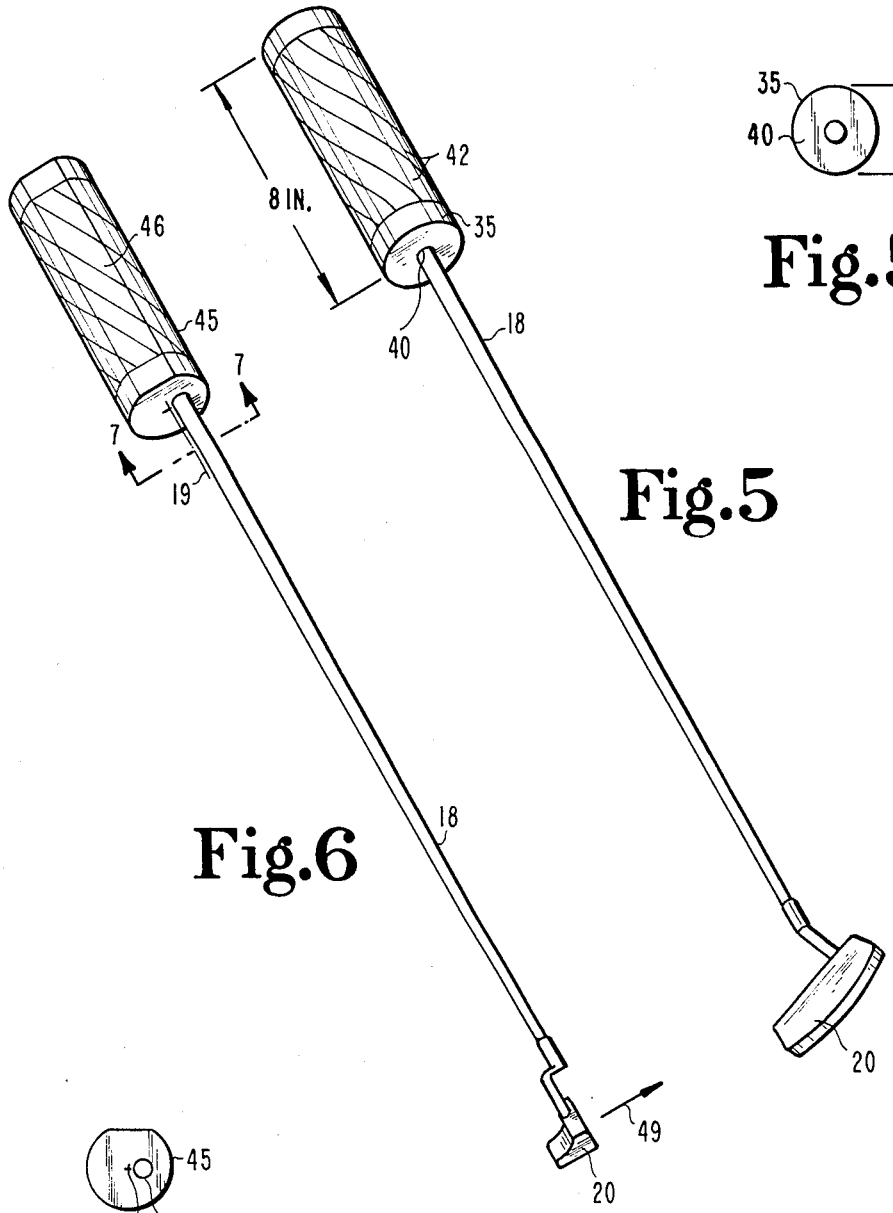
Fig.5
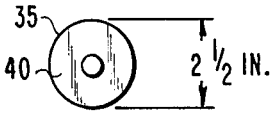
Fig.5A
Fig.6
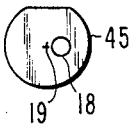
Fig.7

GOLF CLUB PUTTER AND HANDGRIP THEREFOR

FIELD OF THE INVENTION

The present invention relates to the field of golf club putters and in particular to an improved hand grip for a putter.

BACKGROUND OF THE INVENTION

It has been stated that the most deceiving part of the game of golf is putting. It is probably the simplest part of the game and yet the most difficult to master. This is because in putting there is virtually no margin for error. For this reason, there has been a great deal of time spent trying to develop more functional and more comfortable hand grips for golf clubs and putters. There have also been hundreds of ideas expressed about the correct way to stand, the correct way to hold the putter and the correct way to stroke a putt. One fundamental which is almost universally agreed upon is that there should be no wrist motion whatsoever in a putt. Related to this are at least two other, often taught fundamentals. First, the ball should be struck with a square club face and second, the putter head should be kept low to the ground, moving in a straight line. So-called wrist putting, where the club swings in more of an arc, more often than not causes the putter head to open and close severely making it difficult to cause the club face to contact the ball squarely. Where so much precision is required in putting, a slight twisting of the club face in any direction will almost always cause a miss, even in the close shots. The cures most often advanced by the pros to help "wrist breakers" are two: (1) concentrate harder not to break your wrists; and (2) try a different grip such as the reverse overlap, the finger down shaft, the cross-handed, or the hands separated.

In U.S. Pat. No. 4,067,573, issued to Key, Jr., on Jan. 10, 1978, there is disclosed a putter hand grip shaped and constructed to promote control and accuracy during the putting stroke and to provide a more comfortable and efficient grip on the putter. The Key grip is tapered at both the forward and rearward ends. The overall dimensions of the Key grip are stated not to be critical, and the tapered shape of the grip is recited to be uniform from club to club.

In U.S. Pat. No. 4,272,077, issued to Spivey on Jun. 9, 1981, there is disclosed a golf putter grip having a circumference of approximately 15 cm and designed to minimize putter "jerks or yipes" by preventing the non-dominant hand from overriding the dominant hand. This putter is designed for consecutive hand placement along the length of the grip.

In U.S. Pat. No. 4,215,860, issued to Nakamatsu on Aug. 5, 1980, there is disclosed a golf club gripping means adapted to be grasped by the right and left hands of a golfer being disposed side-by-side to each other on the golf club grip. The cross-section of the grip is disclosed to be square and it is intended that this grip allow an unskilled golfer to play golf without taking unnatural attitudes or without injuring himself.

Other golf club grips are disclosed in U.S. Pat. No. 4,338,270, issued to Uffindell on July 6, 1982 and No. 3,606,326, issued to Sparks et al. on Sept. 20, 1971.

None of the above references discloses a hand grip for a golf club putter which aids in keeping the wrists of the golfer from breaking during the putting swing, although several of the disclosed grips are intended to make the grip more comfortable or to transfer a higher percentage of the energy.

It is an object of the present invention to provide a grip for a golf club putter which helps the golfer keep his wrists from breaking during the putting stroke.

Further objects and advantages of the present invention will become apparent from the description of the preferred embodiment which follows.

SUMMARY OF THE INVENTION

This invention provides an improved grip for a golf putter comprising a cylindrical body having a constant radius along its length and a coaxial tubular passage also extending along its length for receipt of the shaft of the putter. A grip surface of rubber or leather surrounds the exterior of the cylindrical body consisting of diagonally wrapped strips. The body of the putter grip is made of a material having a low density and a high degree of internal energy transference such as balsa wood.

BRIEF DESCRIPTION OF THE DRAWINGS

FIG. 5 is a side perspective view of the putter and putter grip of the present invention.

FIG. 5A is an axial cross-sectional view of the putter grip of FIG. 3.

FIG. 6 is a front perspective view of the putter and putter grip of another embodiment of the present invention.

FIG. 7 is a cross-sectional view of the putter grip of FIG. 6.

DESCRIPTION OF THE PREFERRED EMBODIMENT

Figure 1:
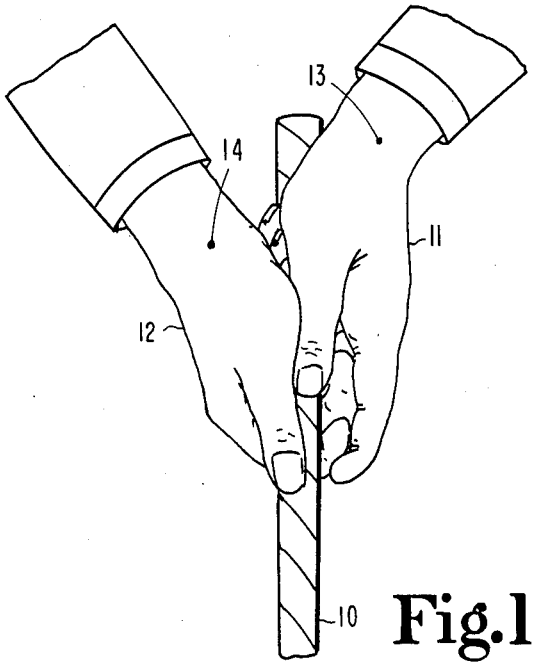
FIG. 1 is a front, elevational view of a standard putter grip in use.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

One embodiment of the present invention provides a grip for a golf club putter which utilizes the geometrical location of the skeletal linkage points of the golfer during the stance and the putting stroke.

Referring now to FIG. 1, there is shown one of the most popular grips for keeping the club face square to the ball. In this grip, using a putter with a standard grip 10, wherein the back of left hand 11 and the palm of the right hand 12 exactly face the target. In this configuration, the palms of both hands are parallel to each other and parallel to the club face (not shown). The approximate point of flexion of the wrist of each hand 11, 12 is indicated at 13 and 14, respectively.

Figure 2:
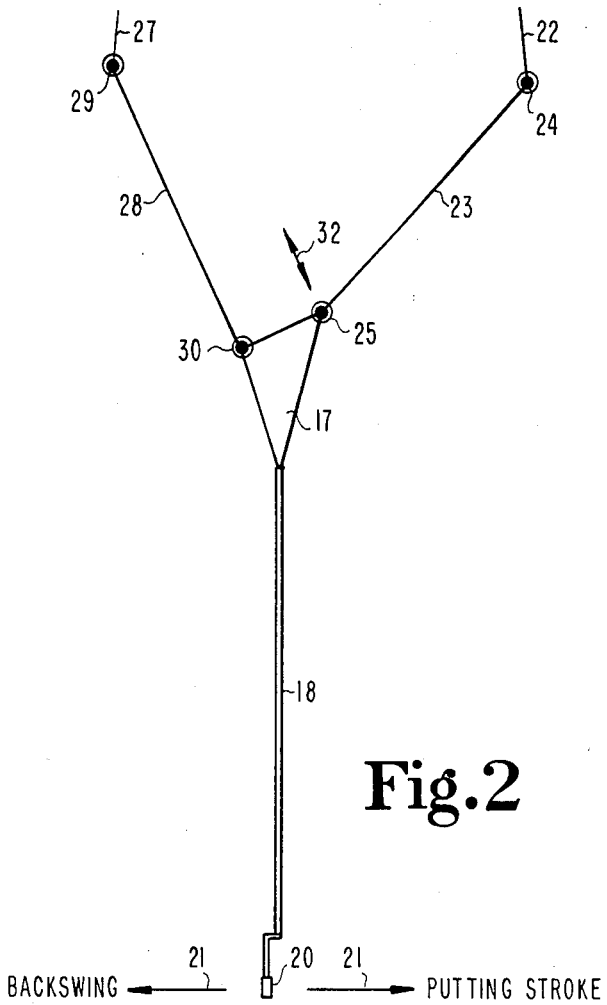
FIG. 2 is a modeling diagram of the use of the putter of FIG. 1.

Shown in FIG. 2 is an approximate modeling of the systems of FIG. 1. For purposes of ideal modeling conditions, the combination of the left hand 11, the right hand 12 and the grip 10 can be assumed to be immovable relative to one another and are represented in FIG. 2 by the triangle 17. For the components of the left arm, line 22 represents the upper arm, line 23 represents the forearm, hinge joint 24 the left elbow and hinge joint 25 the point of flexion between the left forearm 23 and the left hand (triangle 17). For the right arm components, line 27 represents the upper arm, line 28 the forearm, hinge joint 29 the right elbow and hinge 30 the point of flexion between the right hand (triangle 17) and the right forearm 28. The desired movement of club face 20 is in the direction of arrows 21. In fact, it is desired that the entire system comprising hinges 25 and 30, the triangular combination 17, the putter shaft 18 and the club face 20 all move perfectly laterally in the direction of arrow 21. One theory concerning the forces acting during putting is that the combination of forces exerted among the upper arms 22 and 27 and the forearms 23 and 28 toward each other to grasp and hold the putter unit 17 and 18, along with forces exerted in moving the putting unit 17 and 18 in the direction of arrows 21, produces an unstable system between joints 24 and 30. That is, exertion of the muscles in the arms to hold the club and move the club make it difficult to lock the joints 25 and 30 so as not to move the unstable system between joints 24 and 30. As a compressive force component is exerted between joints 24 and 30, it becomes more likely that there will be pivoting at joint 25 and joint 30 causing joint 25, or the left wrist, to move in the direction of arrow 32. This will cause an arcing of the putter shaft 18 increasing the likelihood that the club face 20 will not strike the ball squarely. Further, as the distance between joints 25 and 30 decreases, the arcing of movement of the club face 20 increases for the same magnitude of movement of joint 25 along arrow 32. This means that as the grip 10 narrows and as the palms of hands 11 and 12 come closer to one another, the undesired arc of the club face will become more severe for the same slight break of the wrists.

Figure 3:
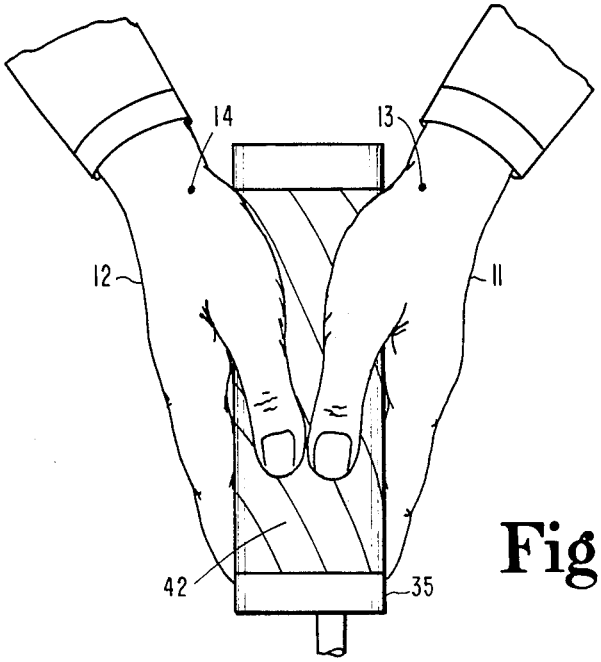
FIG. 3 is a front, elevational view of the use of the putter grip of one embodiment of the present invention.
Figure 4:
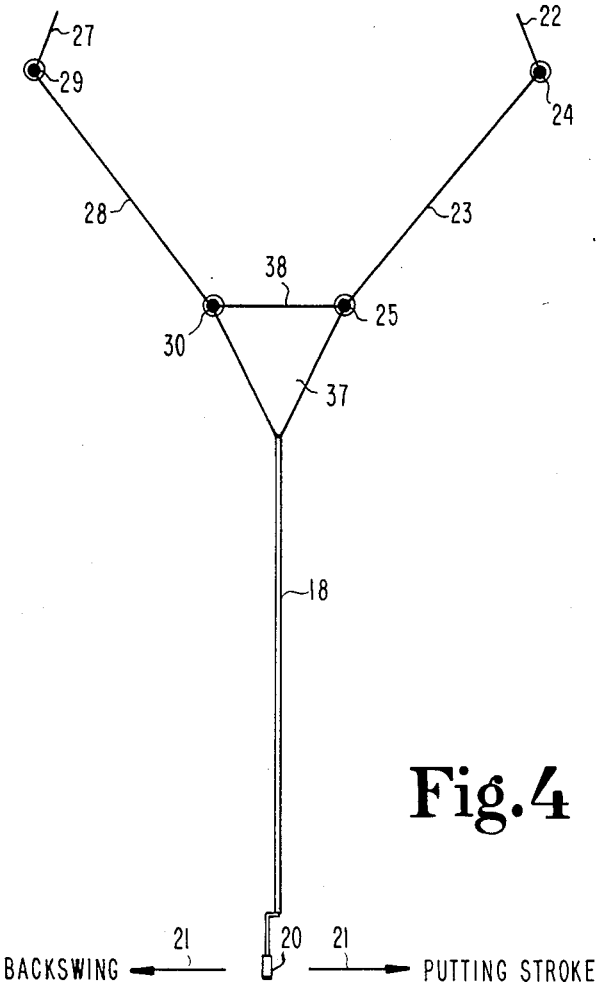
FIG. 4 is a modeling diagram of the use of the putter grip of FIG. 3.

It is believed that the putter grip of one embodiment of the present invention shown in FIG. 3 provides the most stable grip possible for putting. In this situation, the palms of the left hand 11 and the right hand 12 are disposed directly opposite one another on the club grip. The points of flexion 13 and 14 for the left hand 11 and the right hand 12, respectively, are now perfectly symmetrical with respect to the central axis of the club. Again, for purposes of ideal modeling, the combination of the putter grip 35, the left hand 11 and the right hand 12 may be considered to be a single, rigid unit identified in FIG. 4 as 37. Rigidly connected and also a part of that combination is the same shaft 18 as shown in FIG. 2 and the putter face 20. With the hands disposed exactly opposite one another on the putter grip 35, the components of the left arm 22, 24, 23 and 25 are also disposed exactly opposite the components of the right arm 27, 29, 28 and 30. Again, it is desired to move the club face 20 and club shaft 18 along with the combination 37 perfectly laterally in the direction of arrows 21. As is clear from FIG. 4, the left arm components and the right arm components are symmetrical about the grip and club shaft 18. Thus, the compressive forces exerted by the two arms in holding the putter are balanced and do not contribute toward causing pivoting at either joint 30 or joint 35. Looking back at FIG. 2, it is seen that movement of joint 25 in the direction of arrow 32 would require little if any motion of either upper arm 22 or 27 and would require at the most movement of forearm 23 about elbow joint 24. In the case of the model shown in FIG. 4, if the unit 37 were to experience even a slight pivot about joint 30, there would have to be movement of upper arm 22, of elbow 24 and of forearm 23. This analysis also holds true regarding the components of the right arm if there is to be any pivotal movement about joint 25. There is thus another muscle group checking the movement of any wrist breaking at 25 or 30.

If joints 25 and 30 were concentric and lying along a line defined by shaft 18 so that triangle 37 did not exist, then putter shaft 18 could pivot about concentric joints 25 and 30 without causing any movement in the remainder of the arm components. As joints 25 and 30 move apart along line 38, more and more upper and lower arm movement is required to allow any pivot about joints 25 or 30 of shaft 18. The greater the distance between joints 25 and 30, the greater degree of pivotal stability shaft 18 will have relative to the arm components. Although previously designed clubs could be held with the side-by-side grip, the club grip 35 of the present embodiment is specifically designed to promote a side-by-side grip in the aforementioned manner to provide a particular balance of forces.

The distance between joints 25 and 30 is related to the diameter of the club grip 35. There is a point of balance, however, between pivotal stability of the putter shaft and awkwardness of holding or grasping the putter grip. A proper balance was found to exist where the diameter of the putter grip 35 is from approximately 2½ inches to approximately 3 inches.

Being unaccustomed to place the hands side-by-side, directly opposite one another on the grip, the golfer may still choose to stagger the hands slightly, approaching the placement as shown in FIG. 1. However, the overall dimensions of the grip of the present embodiment, being 8 inches (FIG. 5) in length and having a minimum diameter of 2½ inches (FIG. 5A), causes the hands to be placed on the grip in such a way that the balancing of the forces, which act during a putt, will lie somewhere between those shown in FIGS. 2 and 4. Thus, even if the golfer chooses not to use the side-by-side placement approach of FIG. 3, the grip of the present embodiment will nevertheless provide a more stable grip than the standard grip of FIG. 1 and will thus aid the golfer in keeping his wrists from breaking during the putt.

The putter grip 35 (FIGS. 5 and 5A) is cylindrically shaped with a central tubular bore 40. The club shaft of a standard putter is received within the bore 40 and bonded thereto with an appropriate resin. Such a large increase in the size of the putter grip can add substantial mass to the upper portion of the putter thus changing the center of gravity and the entire feel and balance of the putter. It is therefore desirable to compose the body of the putter grip out of a material which has a very low density. It is also desirable for the "feel" of the putter to the golfer that energy not be lost between the putter shaft and the golfer's hands. To assure that the energy and "feel" of the club face striking the ball is properly transmitted to the golfer's hands, a material is used for the body of the grip 35 which has a low damping coefficient. That is, a material is used which does not appreciably decrease or substantially alter the transference of energy within the body of the grip. The material also has a sufficiently high coefficient of restitution between itself and the metal shaft of the putter, again to accurately transfer the energies produced during the putt. It has been found that balsa wood, kiln dried to 8% moisture content having an average density of 23 pounds per cubic foot, adds little weight to the upper portion of the putter, but has acceptable structural properties so that it does not alter or cushion the impact between the grip and the shaft as the ball is struck. Thus, the "feel" of the club is not substantially changed. The grip is then covered with an appropriate grip surface coating such as leather or rubber strips 42 wrapped around the grip in a diagonal fashion. Using a grip as large as in the present embodiment is unnatural for the normal golfer and is therefore designed cylindrically to fit within the natural contour of the curved hand.

Shown in FIGS. 6 and 7 is another embodiment of the present invention in which the shaft 18 of the putter mates with the grip body 45 offset from the central axis of the grip, the offset being in the direction of the target as shown by arrow 49. Here, the shaft 18 of the putter is offset from the central axis 19 of the grip by approximately one-half inch. This design is to provide a more balanced backswing and putting stroke to those golfers who like to position themselves, in the putting stance, slightly offset from the ball. The grip face is also flattened on the frontward portion for the thumbs of the golfer to better grasp the grip. The remainder of the grip must remain cylindrical to provide a comfortable fit of the large diameter grip within the palms of the golfer. The flattened surface 46 is in a plane parallel to the normal of the club face 20 and with the direction of the golf putt 49. The grip is to be flattened so that, at a maximum, only about a quarter of an inch is reduced from the radius at the middle of the flattened portion.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A golf putter for providing a more stable and controllable grip between the hands of an average sized golfer, comprising:

a shaft;

a putter head rigidly attached at one end of said shaft, said head having a face; and a grip attached to said shaft at the opposite end thereof, said grip including a cylindrical body having a uniform diameter of at least two and one half inches over its entire length of at least eight inches.

2. The putter of claim 1 wherein said grip is made of a material having a density less than 25 lbs/ft$^3$.

3. The putter of claim 2 wherein said grip is made of balse wood and has a central bore for receiving said shaft.

4. The putter of claim 1 wherein said bore is coaxial with said grip and said shaft is fixedly bonded to said grip.

5. The putter of claim 1 wherein said bore is offset from and parallel to the central axis of said grip and wherein said shaft is fixedly bonded to said grip.

6. The putter of claim 5 wherein said bore is offset from the central axis of said grip by approximately one-half inch.

7. The putter of claim 6 wherein said offset is in the direction normal to the face of the head of said putter.

8. The putter of claim 5 wherein said grip has a flattened area for placement of thumbs, said flattened area being parallel to the direction normal to the face of the head of said putter.

9. The putter of claim 8 wherein the radial distance from the axis of said grip to any point on said flattened area is no less than one-quarter inch less than the radius of the cylindrical body away from the flattened area.

10. A grip for a golfing putter for use by an average sized golfer, comprising:

a cylindrical body having a central axis, a length of at least eight inches, and a constant diameter of at least two and one-half inches along the entire length thereof, said body also having a tubular passage extending along said length for receiving the shaft of said putter; and.

a grip surface coating surrounding said cylindrical body, said surface coating consisting of strips wrapped diagonally about the exterior surface of said body and being permanently glued to said body.

11. The grip for a golfing putter of claim 10 wherein said body is made of balsa wood.

12. The grip for a golfing putter of claim 11 wherein said tubular shaft is coaxial with the central axis of said body.

13. The grip for a golfing putter of claim 11 wherein said tubular shaft is offset from and parallel to the central axis of said body.

14. The grip for a golfing putter of claim 13 wherein said putter includes a head with a contact face and wherein said offset is in a direction normal to said face.

15. The grip for a golfing putter of claim 14 wherein said offset is approximately one-half inch.

16. A golf putter for providing a more stable and controllable grip between the hands of an average sized golfer, comprising:

a shaft;

a putter head secured to one end of the shaft; and.

a grip secured to the other end of said shaft, said grip including a cylindrical body having a length of at least eight inches and having a uniform diameter from 2½ inches to 3 inches.

* * * * *

UNITED STATES PATENT AND TRADEMARK OFFICE

CERTIFICATE OF CORRECTION

PATENT NO. : 4,746,120

DATED : May 24, 1988

INVENTOR(S) : Richard M. Mockovak

It is certified that error appears in the above-identified patent and that said Letters Patent is hereby corrected as shown below:

In column 2, line 68, please change "systems" to --system--.
In column 6, line 2, please change "balse" to --balsa--.
In column 6, line 30, please change "." to --,--.
In column 6, line 53, please change "." to --,--.

Signed and Sealed this

Twentieth Day of September, 1988

*Attest:*

DONALD J. QUIGG

*Attesting Officer*

*Commissioner of Patents and Trademarks*